US005681177A

United States Patent [19]

Mikolaicyk et al.

[11] Patent Number: 5,681,177

[45] Date of Patent: Oct. 28, 1997

[54] ANTI-DECOUPLING DEVICE

[75] Inventors: John Henry Mikolaicyk, Onconte; Walter L. Feltman, Otego; David Warren MacAvoy, Bainbridge; Gregory John Oleksik, Onconte, all of N.Y.

[73] Assignee: Amphenol Corporation, Wallingford, Conn.

[21] Appl. No.: 378,553

[22] Filed: Jan. 25, 1995

[51] Int. Cl.[6] ..... H01R 4/38

[52] U.S. Cl. ..... 439/321; 439/312

[58] Field of Search ..... 439/312–321, 439/339, 310

[56] References Cited

U.S. PATENT DOCUMENTS

| | | | |
|---|---|---|---|
| 3,917,373 | 11/1975 | Peterson | 439/321 |
| 4,248,492 | 2/1981 | Snyder | 439/312 |
| 4,361,373 | 11/1982 | Gallusser et al. | 439/312 |
| 4,462,653 | 7/1984 | Flederbach et al. | 439/321 |
| 4,468,077 | 8/1984 | Brush, Sr. et al. | 439/312 |
| 4,487,470 | 12/1984 | Knapp et al. | 439/312 |
| 4,500,153 | 2/1985 | Mattingly, Jr. et al. | 439/312 |
| 4,534,607 | 8/1985 | Tomsa | 439/321 |
| 4,588,246 | 5/1986 | Schildkraut et al. | 439/321 |
| 4,603,934 | 8/1986 | Burns | 439/322 |
| 4,900,260 | 2/1990 | Drogo | 439/321 |
| 5,141,448 | 8/1992 | Mattingly et al. | 439/314 |

*Primary Examiner*—Hien Vu

*Attorney, Agent, or Firm*—Bacon & Thomas

[57] ABSTRACT

An electrical connector includes a shell having a radially extending annular flange, a coupling nut, and an anti-decoupling arrangement. The anti-decoupling arrangement is made up of a flexible friction producing member which is captured in a compressed state to hold the coupling nut in place solely by virtue of the frictional engagement between the friction producing member and the coupling nut.

2 Claims, 1 Drawing Sheet

ANTI-DECOUPLING DEVICE

BACKGROUND OF THE INVENTION

1. Field of the Invention

This invention relates to the field of electrical connectors, and in particular to an anti-decoupling mechanism for an electrical connector of the type which includes plug and receptacle subassemblies and which creates a frictional lock between the mated plug and receptacle subassemblies of the connector to prevent the plug and receptacle from becoming decoupled as a result of vibration forces.

2. Description of Related Art

A typical electrical connector to which the present invention may be applied includes a connector shell containing electrical contacts and an internally threaded coupling nut. The connector shell is coupled to a corresponding externally threaded shell by means of the coupling nut in such a manner that electrical contacts in the corresponding shell are aligned with and mate with contacts in the first connector shell.

The problem addressed by the present invention is that complementary connector shells of the above-described type may become decoupled as a result of rotation of the coupling nut relative to the first connector shell under the influence of vibrations, such as might occur if the connector is used in a moving vehicle or aircraft. The reason such vibrational loosening occurs is that the coupling nut is conventionally held on the first connector shell solely by means of one or more snap rings designed to captivate a radial flange of the coupling nut, and the frictional anti-locking force generated by engagement between the snap rings and the coupling nut is insufficient to prevent vibrational rotation.

A number of conventional decoupling arrangements which address the problem of vibrational loosening in this type of connector are known, including those briefly described below. Many of these arrangements provide an acceptable anti-decoupling effect, but each is relatively high in cost and complexity.

The improvement provided by the present invention is to reduce the anti-decoupling arrangement to an absolute minimum number of parts, using a completely frictional locking mechanism, without sacrificing anti-decoupling effectiveness. All of the known prior arrangements require either a mechanical detent, or a greater number of parts than is required for the present invention.

U.S. Pat. No. 4,588,246, for example, discloses a coupling assembly which establishes a lock between a connector plug and receptacle using a flexible metal band having a lock arm. The assembly includes a threaded coupling nut having a radial flange positioned between an annular flange of the plug shell and the metal band, such that when the coupling nut is rotated, the metal band radially contracts under the force of the advancing flange to establish a mechanical lock between the connector plug and receptacle.

Similarly, U.S. Pat. No. 4,462,653 discloses an anti-decoupling mechanism made up of a waved washer disposed between a coupling ring and a sleeve attached to a threaded plug shell. Again, the anti-decoupling arrangement relies upon a mechanical lock formed between a plurality of detents located on the coupling ring and a plurality of corresponding protuberances located on the plug shell.

U.S. Pat. No. 4,361,373, on the other hand, discloses an anti-decoupling mechanism which includes a waved washer positioned between a shoulder of a threaded plug connector housing and a flange on a coupling ring mounted on the connector housing by a snap ring, the snap ring captivating the coupling ring flange between itself and the waved washer. When the coupling ring is rotated, the waved washer is axially compressed between the shoulder and the flange to create a frictional lock which prevents the connector housing from becoming decoupled. In this arrangement, washers are positioned on either side of the waved washer to prevent wear on the shoulder and flange during use, thereby greatly increasing the cost and complexity of the arrangement.

Other anti-decoupling mechanisms of similar relevance are disclosed in U.S. Pat. Nos. 4,603,934, 5,141,448, 4,500,153, and 4,534,607. None of these arrangements discloses an anti-decoupling device made up of an exclusively frictional lock consisting of as few elements as the anti-decoupling device of the invention.

SUMMARY OF THE INVENTION

It is accordingly an objective of the invention to overcome the disadvantages of known anti-decoupling arrangements by providing a frictional substitute for conventional mechanical anti-decoupling arrangements using a minimum number of discrete parts and yet which provides any desired level of anti-decoupling protection.

This objective is accomplished, according to a first preferred embodiment of the invention, by providing an anti-decoupling arrangement which includes a flexible friction producing member in the form of one or more waved washers captivated between a radial flange of a coupling nut and a snap ring located in an annular groove surrounding an unthreaded portion of the plug shell. The coupling nut flange is positioned so that it adjoins a raised shoulder formed on an annular flange extending radially from an exterior surface of the plug shell. In operation, when the coupling nut is rotated, the waved washers are compressed between the snap ring and coupling nut flange until a tight frictional lock is formed.

In a second preferred embodiment of the invention, the snap ring is completely removed and the flexible friction producing member has taken its place in the annular groove. In addition, the coupling nut flange is equipped on one side with a counterbore for captivating the flexible friction producing member and compressing them against one of the vertical walls forming the groove, and the other side of the flange adjoins the raised shoulder of the plug shell such that, in operation, the flexible friction producing member is captured between an edge of the groove and the coupling nut flange.

In a third preferred embodiment of the invention, the flange of the coupling nut is positioned between a snap ring positioned in a groove in an unthreaded portion of the plug shell and at least one waved washer, and the waved washer adjoins and is compressed against the raised shoulder of the unthreaded plug shell such that, in operation, the flexible friction producing member is compressed between the raised shoulder of the unthreaded portion of the plug shell and the coupling nut flange as the coupling nut is tightened during coupling to a mating connector.

Finally, according to a fourth preferred embodiment of the invention, the anti-decoupling arrangement of the first three embodiments of the invention is equipped with an anti-vibration feature, which may be a ring containing a projection which engages a hole or groove formed around the exterior surface of the plug shell shoulder when the subassemblies are mated to their full extent. The anti-vibration feature adds a mechanical lock to the frictional lock already established by the between waved washer and the coupling nut flange.

DETAILED DESCRIPTION OF THE PREFERRED EMBODIMENTS

Figure 1:
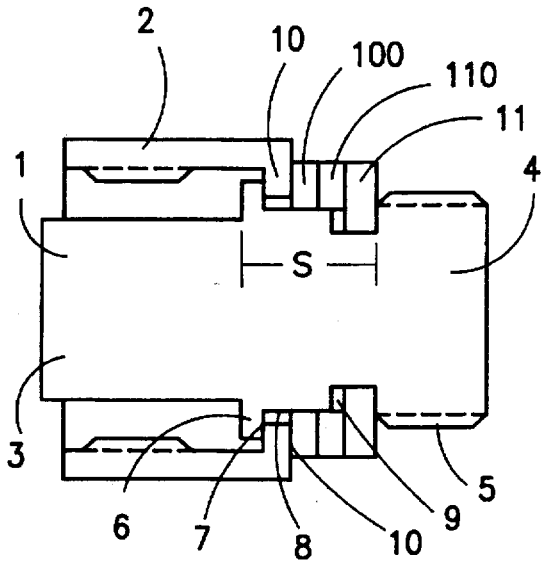
FIG. 1 is a cross-sectional side view of an anti-decoupling device for an electrical connector according to a first preferred embodiment of the invention.

As shown in FIGS. 1–4, the anti-decoupling arrangements of the four preferred embodiments of the invention share a connector shell 1 on which is to be fitted a coupling nut 2. The coupling nut is of standard type and is designed to be threaded onto a corresponding externally threaded portion of a mating connector (not shown). Connector shell 1 is illustrated as being in the form of a plug shell of the type disclosed in the above-mentioned U.S. Pat. No. 4,462,653, although it will be appreciated by those skilled in the art that the principles of the invention may be extended to cover a variety of different connector shell configurations, so long as the context is one which involves a connector shell to which a coupling nut is to be non-rotatably affixed.

In each of the preferred embodiments, plug shell 1 includes a cylindrical forward portion 3 which encloses a contact pin-containing insert (not shown), a rearward end 4 having external threads 5, and an external radial flange 6 of the type which in the prior art accommodated ratchet teeth, but which is replaced in the preferred embodiments by a square shoulder 7 located medial the ends of the shell, the square shoulder 7 defining together with threads 5 a medial unthreaded portion 8 of the connector shell 1. The inclusion of a square shoulder provides a more complete seal than the conventional ratchet teeth and therefore increases EMI protection for the signal contacts in the connector. Medial portions 8 in each of the embodiments differs as follows:

In the embodiment shown in FIG. 1, medial portion 8 includes a groove 9 sufficiently large to accommodate a snap ring or threaded nut and which is set back from the annular flange by a distance S sufficient to accommodate a rear flange portion 10 of the coupling nut, and a flexible, friction producing member, depicted as two stainless steel waved washers 100 and 110. It will be appreciated by those skilled in the art that while two flexible devices are illustrated, a single flexible friction producing member, or more than two such Cevices, may be substituted. In addition, the flexible friction producing member need not necessarily be made of metal, but rather could be made of rubber or plastic.

In operation, when coupling nut 2 of the embodiment depicted in FIG. 1 is rotated, the flexible friction producing member 100,110 is compressed between the snap ring or unthreaded nut 11 to thereby increase the frictional force provided by the anti-decoupling arrangement. Those skilled in the art will appreciate that by suitably selecting distance S based on the final tightening torque of the coupling nut when assembled to the mating connector shell, the thickness of the snap ring or unthreaded nut 11, and the frictional properties and compressibility of the flexible friction producing member 100,110, any desired anti-decoupling force can be obtained.

Figure 2:
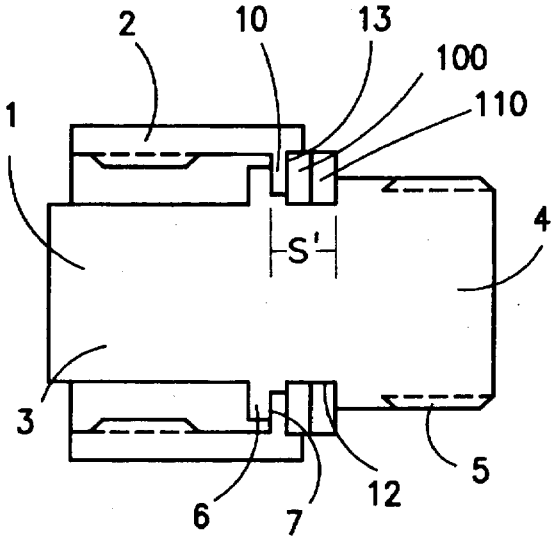
FIG. 2 is a cross-sectional side view of an anti-decoupling device for an electrical connector according to a second preferred embodiment of the invention.

In the embodiment shown in FIG. 2, medial portion 8 includes a groove 12 arranged to directly accommodate the compressed flexible friction producing member (100,110). In addition, in this embodiment, a first surface of the rear flange portion 10 of the coupling nut includes a counterbore 13 for captivating the flexible friction producing member and compressing it against one of the vertical walls forming the groove, the second surface of the coupling nut flange adjoining shoulder 7 on flange 6 of the connector shell 1.

In operation, the anti-decoupling force is obtained in this embodiment when the flexible friction producing member 100,110 is compressed between the one of the vertical walls of groove 12 and the rear flange 10 of the coupling nut as the coupling nut is rotated. Again, those skilled in the art will appreciate that by suitably selecting the distance S' between shoulder 7 and the rearwardly situated vertical wall of groove 12, based on the final tightening torque of the coupling nut when assembled to the mating connector shell, the thickness of the snap ring or unthreaded nut 11, and the frictional properties and compressibility of the flexible friction producing member 100,110, any desired anti-decoupling force can be obtained.

Figure 3:
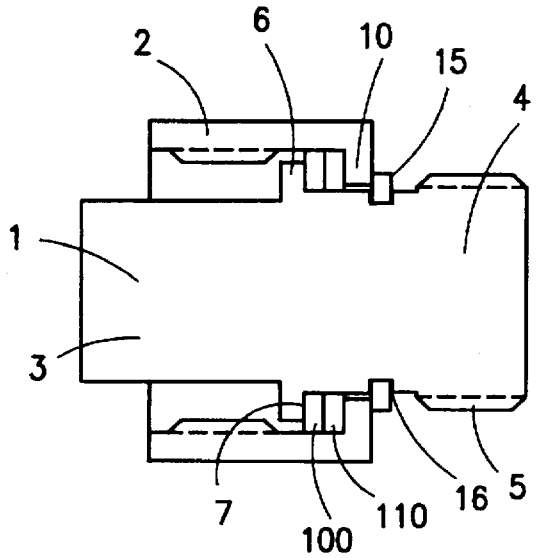
FIG. 3 is a cross-sectional side view of an anti-decoupling device for an electrical connector according to a first preferred embodiment of the invention.

The embodiment shown in FIG. 3 is similar to the embodiment shown in FIG. 1, except that the compressed flexible friction producing member (100,110) is positioned between a front surface 14 of flange 10 of the coupling nut 2 and shoulder 7 of the annular flange 6. A snap ring or threaded nut 15 positioned in a groove 16 is again used to hold the assembly in place. This embodiment allows slight movement of the coupling nut in the uncoupling direction while still maintaining a metal-to-metal friction lock (if a metal flexible friction producing member, such as at least one waved washer, is used).

In operation, in the embodiment illustrated in FIG. 3, the flexible friction producing member is compressed between the raised shoulder 7 and the coupling nut flange 10 as the coupling nut is tightened during coupling to a mating connector. In this embodiment, however, the anti-decoupling force is determined solely by the properties of the flexible friction producing member itself, snap ring 15 serving to loosely hold the coupling nut in place before coupling.

Figure 4:
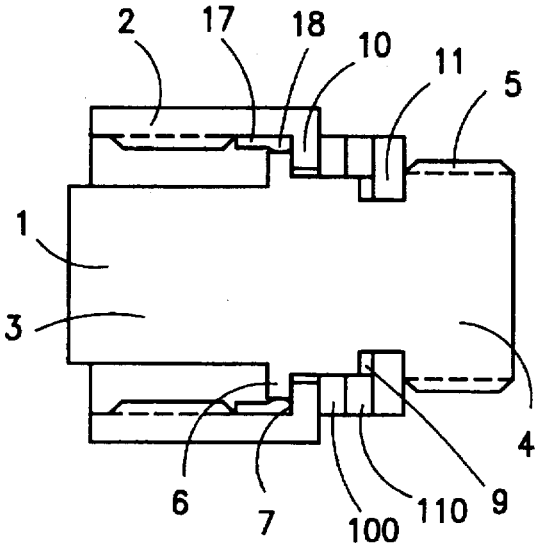
FIG. 4 is a cross-sectional side view of an anti-decoupling device for an electrical connector according to a second preferred embodiment of the invention.

The final embodiment shown in FIG. 4 involves the use of the preferred anti-decoupling arrangement of any of the embodiments shown in FIGS. 1–3 (the arrangement of FIG. 1 is shown, but either of the other two embodiments could easily be substituted) with a conventional antivibration feature involving a spring member 17 and detent 18.

Having thus described a preferred embodiment of the invention, however, the inventors recognize that numerous variations of the preferred embodiment will undoubtedly occur to those skilled in the art, and intend that the invention be defined to include all such variations. For example, Consequently, it is intended that the invention not be limited to the preferred embodiment described herein and illustrated in the drawings but rather that it be limited solely by the appended claims.

We claim:

1. An electrical connector, comprising:

an electrical connector shell having a radially extending annular flange which includes a shoulder;

a coupling nut having a threaded portion and a flange portion; and an anti-decoupling arrangement, the improvement wherein:

the anti-coupling arrangement consists of a flexible friction producing member and means for capturing the flexible friction producing member and holding it in compressed state against said flange portion of the coupling nut when the coupling nut is threaded onto a mating connector shell to provide an anti-rotation function, wherein the capturing means comprises a groove in said connector shell, and said flexible friction producing member is retained in said groove and thereby caused to engage a first surface of said flange portion of the coupling nut, whereby a second surface of the flange portion of the coupling nut is held against said annular flange.

2. An electrical connector as claimed in claim 1, wherein said flexible friction producing member is arranged to engage a first surface of the flange portion of the coupling nut, whereby a second surface of the flange portion of the coupling nut is held against said annular flange, and wherein said first surface of the flange portion of the coupling nut is formed by a counterbore in said flange portion.

* * * * *